US006418283B1

(12) United States Patent
Wegman et al.

(10) Patent No.: US 6,418,283 B1
(45) Date of Patent: Jul. 9, 2002

(54) COMMUNICATIONS CARTRIDGE

(75) Inventors: Paul M. Wegman, Pittsford; J. Stephen Kittelberger, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 4 days.

(21) Appl. No.: 09/677,528

(22) Filed: Oct. 2, 2000

(51) Int. Cl.[7] ..... G03G 15/08

(52) U.S. Cl. ..... 399/106; 399/262; 116/100; 206/459.1; 215/201; 340/545.6

(58) Field of Search ..... 340/603, 545.6; 222/39; 116/100, 280; 206/459.1, 534; 215/201, 400; 399/12, 24, 258, 262, 106

(56) References Cited

U.S. PATENT DOCUMENTS

| | | | | | |
|---|---|---|---|---|---|
| 4,381,558 | A | | 4/1983 | Bearden | 369/68 |
| 4,801,929 | A | * | 1/1989 | Instance | 215/201 |
| 4,851,875 | A | | 7/1989 | Tanimoto | |
| 4,961,088 | A | | 10/1990 | Gilliland et al. | |
| 4,989,754 | A | * | 2/1991 | Grasso et al. | 222/167 |
| 5,187,498 | A | * | 2/1993 | Burger | 222/105 |
| 5,387,108 | A | | 2/1995 | Crowell | 434/319 |
| 5,426,594 | A | | 6/1995 | Wright et al. | 364/419.2 |
| 5,433,035 | A | | 7/1995 | Bauer | 40/124.1 |
| 5,444,767 | A | | 8/1995 | Goetcheus et al. | 379/67 |
| 5,486,899 | A | * | 1/1996 | Iimori et al. | 340/5.8 |
| 5,499,465 | A | | 3/1996 | Manico | 40/152 |
| 5,575,383 | A | * | 11/1996 | Seeley | 206/217 |
| 5,577,918 | A | | 11/1996 | Crowell | 434/319 |
| 5,905,429 | A | | 5/1999 | Hornstein et al. | 340/384.6 |
| 6,000,773 | A | | 12/1999 | Murray et al. | 347/7 |
| 6,259,794 | B1 | * | 7/2001 | Dobbins et al. | 215/400 |
| 6,271,753 | B1 | * | 8/2001 | Shukla | 340/545.6 |
| 6,298,990 | B1 | * | 10/2001 | Amrod et al. | 206/457 |

* cited by examiner

*Primary Examiner*—Robert Beatty
(74) *Attorney, Agent, or Firm*—Robert Thompson

(57) ABSTRACT

An article including: a container with an opening which container is adapted to accommodate and dispense the contents therefrom; a closure seal in contact with the container; and a signal module in communication with the closure. When the closure is infringed by an operator, the signal module will be activated causing, for example, the container to vibrate for a set period of time. This container may be sealed by first and second seals.

20 Claims, 4 Drawing Sheets

COMMUNICATIONS CARTRIDGE

CROSS REFERENCE TO COPENDING APPLICATIONS AND RELATED PATENTS

Attention is directed to commonly owned and assigned U.S. Pat. Nos. 5,038,319; 5,369,469; 5,960,228; 5,241,402; 3,882,305; and 5,057,866, relating generally to remote interactive communications, diagnostics, or control schemes in printing machines.

Attention is directed to commonly assigned copending application: U.S. Ser. No. 08/978,307 (D/97162) which discloses an electrophotographic printing or copying machine including a functional module which can be readily removed and replaced by service personnel. Each module includes a monitor in the form of an electronically-readable memory, which includes information about how the particular module is to be operated. A distribution board electronically accesses the memories within the monitors and reads therefrom information, such as how much energy to supply to different components within each module. The distribution board can also update the number of prints made with each module, and maintain this count within the memories of the monitors.

The disclosures of each the above mentioned patent and copending applications are incorporated herein by reference in their entirety. The appropriate components and processes of these patents may be selected for the toners and processes of the present invention in embodiments thereof.

BACKGROUND OF THE INVENTION

The present invention is generally directed to cartridges, such as particle or liquid dispenser containers, and more specifically, to communicating cartridges, that is, "smart" toner and replenisher cartridges and similar intelligent articles or devices, and printing systems and printing processes incorporating the intelligent cartridges. The cartridges of the present invention can be adapted to provide value-added features and enhanced performance capabilities to known stand-alone, clustered, and net-worked printing devices. The present invention also relates to communicating cartridges which are capable of providing a customer, a user, or an operator with useful or helpful marketing oriented informational messages, for example, a promotional message or messages, or a reorder message or messages, and combined informational and promotional messages, or multiple messages. The present invention also relates to communicating cartridges which are capable of providing a customer or user-operator with useful or helpful cartridge handling or installation oriented informational messages, for example, instructions for shaking or agitating the cartridge for a proper or prescribed time duration or in a particular fashion, or additionally or alternatively, provide a user or an operator with a signal or equivalent message that the cartridge has been properly activated, for example, by removal of a protective seal or seals, or by sufficient agitation of the cartridge contents, such as a developer, to permit proper installation of the cartridge in a machine and to assure proper machine operation. The present invention also relates to communicating cartridges which are capable of providing an appropriately configured printing or copying machine, for example, with information about the contents of the cartridge, with information about the readiness state of the cartridge contents, or with information about the suitability or compatibility of a particular cartridge with a particular printing or copying machine, for example, a machine adapted to receive a message or signal information from an intelligent cartridge of the present invention. The present invention also relates to a system for controlling replaceable modules, also known as "customer replaceable units" or CRUs, for example in a digital printing apparatus, such as a digital electrophotographic printer or copier. These and other embodiments of the present invention disclosed herein.

In a typical electrostatographic printing system, a light image or digital image of an original to be reproduced is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or another support sheet such as plain paper. Other related marking technologies are known, for example, liquid immersion development, and solid or liquid ink jet imaging technologies wherein a liquid, solid, molten, sublimed, and the like marking formulations are deposited onto an imaging member, imaging intermediate member, or image receiver and wherein the marking or imaging material is typically conveniently packaged for end-user or operator installation. Thus it is readily apparent to one of ordinary skill in the art that embodiments of the present invention are readily adaptable to other marking formulations and other marking materials, and related consumable materials, such as, replenishers, photoreceptors, fuser rolls, backer rolls, fuser oils, cleaning formulations, papers or transparency stock, such as high quality or specialty receivers, "T"-shirt transfers, and the like machine consumable materials.

In embodiments, the communicating cartridges and the like intelligent packaging of the present invention provides unexpected benefits and superior satisfaction levels to end-use customers or operators, for example, in facilitating positive use experience and avoiding negative use or "trouble" experience, for example, avoiding materials waste or machine damage or downtime and productivity losses associated therewith that results from wrong or improper consumables selection or installation. These and other advantages of the present invention are illustrated herein.

PRIOR ART

In U.S. Pat. No. 5,577,918, issued Nov. 26, 1996, and U.S. Pat. No. 5,387,108, issued Feb. 7, 1995, both to Crowell, there is disclosed an integrated circuit constructed for recording, retaining, and delivering an audible message upon demand and securely retaining the circuit means in a housing, a unique, multi-purpose, audible message delivery system is attained for use either independently or in cooperative relationship with a plurality of alternate products. In the preferred embodiment, the integrated circuit is constructed to provide ease of message re-recording upon demand. In this way, any desired message can be substituted for an existing message whenever desired. As a result, repeated use of the audible message delivery system is realized, with the system being used independently or in association with other products, such as picture frames, medicine packages, folders, notebooks, etc. In this way, specific messages can be easily transmitted between individuals in a manner previously unattainable.

In U.S. Pat. No. 5,426,594, issued Jun. 20, 1995, to Wright, et al., there is disclosed an electronic greeting card communication system (100) which includes a first personal communicator (102), an electronic mail server (136), and a second personal communicator (102). The first personal communicator accepts off-line selection of an electronic greeting card from a user (502), and then transmits a request message corresponding to the off-line selection. The electronic mail server (136) receives the request message and then wireless transmits an electronic greeting card message to the second personal communicator (102) and updates billing information (620) for billing the user of the first personal communicator (102). The second personal communicator (102) selectively receives the wireless transmitted electronic greeting card message and presents it to a user.

In U.S. Pat. No. 5,433,035, issued Jul. 18, 1995, to Bauer, there is disclosed an entertainment card device such as a baseball trading card or a music rock star trading card comprising a flat, rectangular card including a touch sensitive element for sound activation. Replaceable electrical power batteries are mounted within the card. The touch sensitive element is activated by simply touching a surface area of the front side of the flat rectangular card. The entertainment card device further includes entertainment pictures such as of sports figures or music rock star images.

In U.S. Pat. No. 4,381,558, issued Apr. 26, 1983, to Bearden, there is disclosed a talking greeting card with a front display panel and overlapping rear panels adapted to lie substantially flat in one configuration. The front panel may be bowed in convex shape and held in such second configuration by tabs which secure the rear panels together in tension. A flexible sound record strip extends through a slot in the bowed front panel and has a surface prepared to produce sounds when a sliding element, such as the thumb nail of a user, moves along the surface. The sound is amplified by the bowed front wall and overlapping rear walls which act as a sound amplifier.

In U.S. Pat. No. 5,444,767, issued Aug. 22, 1995, to Goetcheus, et al., there is disclosed systems and methods for recording and delivering personalized audio messages. The system includes a central facility computer system (CF), a store front programming system (SFS), and a portable playback device (PPD). When a customer desires to send a personalized message to another person, the customer communicates via a telecommunications channel with the CF. Under control of a CF processor, a outgoing message module of the CF provides instructions to the customer, who enters required information and provides the personalized audio message. The personalized audio message is digitized by a CF voice digitizer and transmitted from the CF via a data interface to the SFS. The SFS receives the digitized personalized audio message data from the CF and uses its playback device programmer to program data representing the audio message onto the PPD. The PPD is an audio chip having a nonvolatile memory, an external switch, a battery and a speaker. When the switch is pressed, the data representing the audio message stored in the memory is sent to the speaker (via a D/A converter where the data is digital) where a facsimile of the original audio message is heard.

In U.S. Pat. No. 5,499,465, issued Mar. 19, 1996, to Manico, there is disclosed a talking picture frame that includes a pressure-sensitive switch which, when activated, e.g., by lifting the frame from a frame-supporting surface, electrically energizes an audio system housed within the frame to playback a prerecorded personal message which augments the visual information represented by a framed picture. Preferably, the switch includes a plunger-type switch actuator which normally extends downwardly from the bottom edge of the frame. When the bottom edge of the frame is resting on a supporting surface, e.g. a table top, the weight of the frame, in cooperation with the supporting surface, moves the actuator, against a spring force, to a retracted position in which no electrical power is provided to the audio system. When the frame is lifted, the switch actuator moves through a position in which a control signal is produced which initiates playback of the recorded message. Preferably, the switch actuator is movably mounted on the frame so as to extend outwardly from either of two different edges of the frame, whereby the actuator can be engaged and moved to its retracted position by the frame-supporting surface whether the frame is supported in a landscape or portrait orientation.

In U.S. Pat. No. 5,905,429, issued May 18, 1999, to Hornstein, et al., there is disclosed an audio label comprising a circuit board substrate with a sound-generating microchip and a photovoltaic cell both attached to the substrate such that the microchip is electrically connected to the photovoltaic cell so that power is provided to the sound-generating microchip. A sound reproduction unit is also attached to the substrate and is connected to the sound-generating microchip communicates signals to the sound reproduction unit which are then converted by the sound reproduction unit to audible sounds. A system for audio label operation is also disclosed. The system includes a separate transmitter which transmits electromagnetic waves, such as light, infrared or radio waves to one or more audio labels which have electromagnetic wave receiving circuit elements, such as phototransistors disposed thereon. The transmitter thus sends wave signals to each label each of which then converts the wave signals to electric signals which each sound reproduction unit then converts to audible sounds.

In U.S. Pat. No. 4,961,088, issued Oct. 2, 1990, to Gilliland, et al., there is disclosed a monitor/warranty system for electrostatographic reproducing machines in which replaceable cartridges providing a predetermined number of images are used, each cartridge having an EEPROM programmed with a cartridge identification number that when matched with a cartridge identification number in the machine enables machine operation, a cartridge replacement warning count, and a termination count at which the cartridge is disabled from further use, the EEPROM storing updated counts of the remaining number of images left on the cartridge after each print run.

In U.S. Pat. No. 4,851,875, issued Jul. 25, 1989, to Tanimoto, there is disclosed an image forming apparatus including a main body and a processing unit detachably mounted in the main body. The processing unit includes at least one of an image bearing member and developing device. The number of image forming repetitions of the processing unit are counted by a counter in the main body. When the counted number for the processing unit reaches a reference value representing the effective life of the processing unit, an alarm device actuates to notify the user that the effective life of the processing unit has been reached.

In U.S. Pat. No. 6,000,773, issued Dec. 14, 1999, to Murray, et al., there is disclosed an ink jet printer cartridge which includes a memory storage element mounted on a side surface thereof. The memory storage element stores information about ink expelled from the cartridge. The information is routed from the memory storage element to an external device, and the user may be warned when cartridge replacement is advisable.

The aforementioned references are incorporated in their entirety by reference herein. There remains a need for smart or machine intelligent toner and developer cartridges that enhance customer satisfaction, improve operator convenience and efficiency, and further printer or copier reliability and print quality. The communicating cartridges of the present invention are useful in electrophotographic imaging processes and apparatuses, especially color and digital applications.

SUMMARY OF THE INVENTION

Embodiments of the present invention, include:

An article comprising:

a container with an opening which container is adapted to accommodate and dispense the contents therefrom;

a closure in contact with the container; and a signal module in communication with the closure;

An article comprising:

a container with an opening which container is adapted to accommodate and dispense the contents therefrom;

a closure in contact with the container;

a signal module in communication with the closure; and a transmitter module adapted to send a signal or signals from the signal module to a receiver module resident in a target printing machine; and A method of operating a printing apparatus comprising:

providing a subsystem in the apparatus, the subsystem being disposed in a module which is separable from the apparatus, the module having permanently associated therewith an electronically-readable memory;

polling the electronically-readable memory of the module for compatibility information prior to the installation and use of the module in the apparatus; and comparing the compatibility information of the module with compatibility information resident in an electronically-readable memory in the printing apparatus.

These and other embodiments of the present invention are illustrated herein.

DETAILED DESCRIPTION OF THE INVENTION

Figure 1:
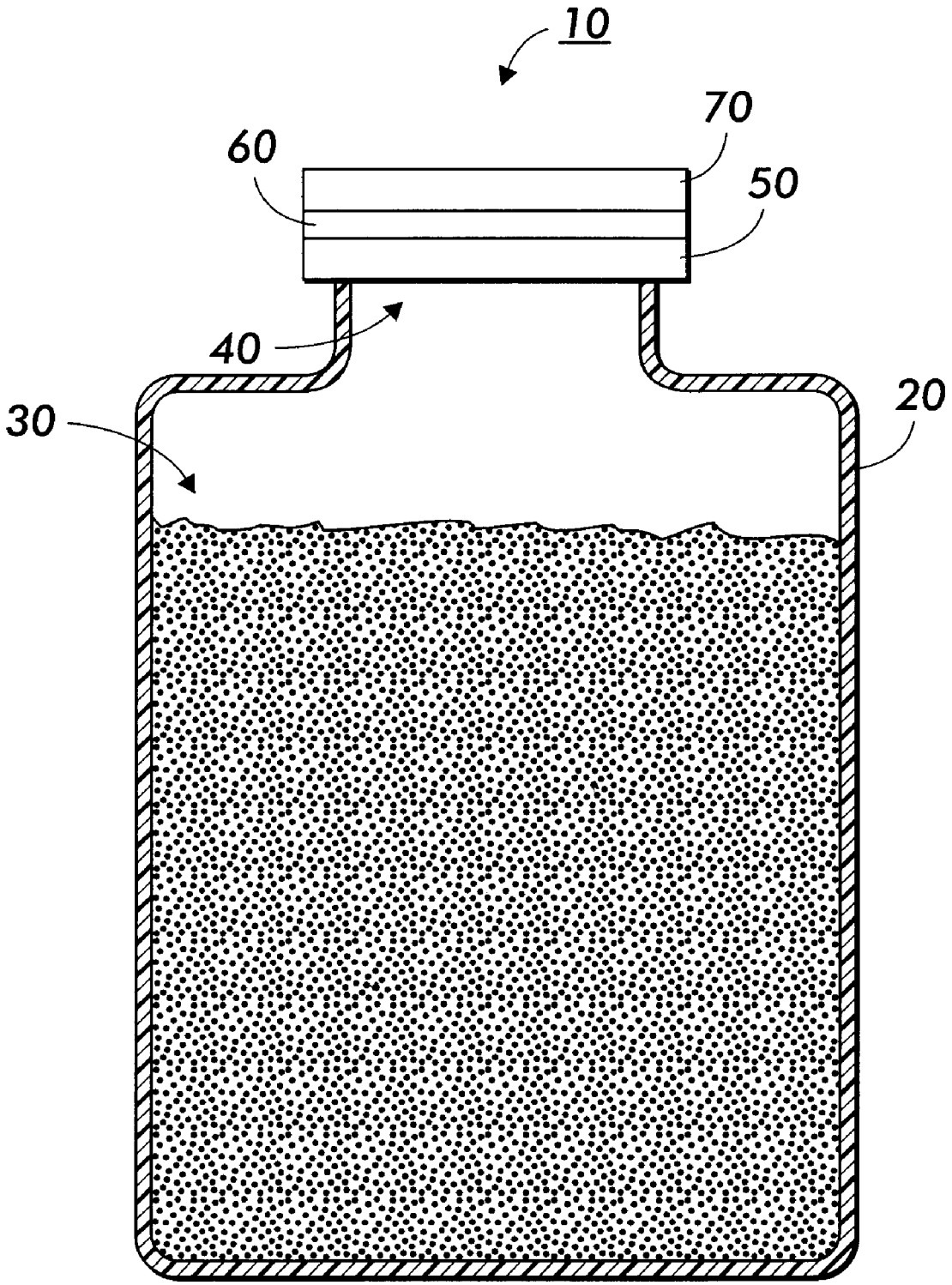
FIG. 1 illustrates a cross-section view an exemplary container article and associated closure which provides, upon activation, a signal to a user-operator or a target printing machine, in embodiments of the present invention.

In embodiments of the present invention the intelligent cartridges can be configured to provide one or more audible marketing or promotional messages, which messages can, for example, inform a user-operator of, such facts as the source, manufacturer, or local supplier of the cartridge; the quality of the cartridge contents; a telephone number or world wide web address for reordering or requesting a refilled cartridge; an audible rebate or coupon offer, and the like informational collaterals.

In another embodiment of the present invention the cartridge can be configured to provide improved cartridge functionality and performance, for example, providing one or more audible instructional or directional messages to a user or operator, such as the end-use customer or a key operator or a field service person.

In embodiments of the present invention the cartridge can be configured to provide one or more audible or inaudible signals between the cartridge and the recipient machine or intended printing device, and optionally provide interactive communication between the cartridge and the recipient machine, to enable and insure that, for example, a proper match and fit between a cartridge, such as dimensional aspects and material aspects of the cartridge and its contents, and the recipient machine is achieved and mismatch problems are avoided. Communications between the cartridge and the recipient machine can be accomplished by, for example, an ultrasonic or radio transmitter and receiver situated in either or both the cartridge and the recipient printing device, as desired, so that a one-way or two-way communication link is established between the cartridge and a target or host device, such as a printer or copier device.

The present invention in embodiments provides a smart cartridge or intelligent material dispenser article which can effectively communicate to a user-operator useful and helpful information about, for example: the use and handling of the cartridge and information about the proper installation of the cartridge in a printing or copying machine; and promotion information, such as, reorder part numbers, supplier or service contact information, advertising information, and the like collaterals.

The present invention in embodiments provides a smart cartridge or intelligent material dispenser article which can effectively communicate, for example, by producing and transmitting a signal between itself and a prospective or recipient machine, such as a printer or copier, and alternatively or additionally, be receiving a signal or message from a prospective or recipient machine, thereby enabling one-way or two-way communications between a cartridge and a printing device. The communicating ability of the smart cartridge and the corresponding printing device can be further adapted to, or integrated with, known remote interactive communications, also known as "RIC" technology, reference for example, aforementioned commonly owned and assigned U.S. Patents, the disclosures of which are incorporated herein by reference in their entirety. For example, in embodiments a smart cartridge can be adapted with appropriate sensor technology to permit electronic sensing of the condition of the cartridge or its contents, for example, whether the cartridge is full, partially empty, or completely empty, or whether the contents are "settled" or "fluidized", or whether the contents are in a condition suitable for dispensing and use by a printing machine generally, or a specific model or configuration of printing machine in particular. A smart cartridge of the present invention can communicate or send a signal, for example, an audible or an inaudible message to a user-operator, and which signal can inform or instruct an operator in a useful way. Alternatively or additionally, a smart cartridge can communicate or send a signal, for example, an audible or an inaudible message, from the cartridge to a host printing device.

In embodiments the present invention provides an article comprising:

a container with an opening which container is adapted to accommodate and dispense the contents therefrom;

a closure in contact with the container; and a signal module in communication with the closure.

Thus the present invention in embodiments provides a "talking cartridge" and, alternatively or additionally, a "talking CRUM" which articles can provide to a user-operator or customer valuable audible informational, promotional, and like message content by way of, for example, an integrated signal module which is in communication with a closure and which closure is in communication with a container or package and which signal module and closure can sense and communicate aspects of the closure, the container or package, or both. The CRUMs or "customer replaceable unit monitors" in embodiments of the present invention can record and communicate useful operational information about itself, for example, a CRUM can be pre-recorded with useful information, or a CRUM can be record CRUM status information over time. The information can be communicated to a user-operator or to a cooperating machine, such as a printing device, for example, periodically, upon-event, on-command, or predetermined combinations thereof.

In an embodiment the closure preferably must be "infringed" by a user-operator before the contents of the container can be dispensed. The term infringed refers to any action by an operator-user or otherwise, such as a key operator or a casual user, for example, where the closure is disturbed, broken, scratched, removed from contact with the container, and the like actions, where such actions are performed directly or indirectly by the user-operator, such as, presenting to or installing the smart cartridge in a printing machine. In other embodiments, if the closure is infringed by a user-operator then the signal module can be activated. The resulting activated signal module can then in turn generate an audible signal and which signal is directed to, and can be readily heard by a user-operator. In embodiments the audible signal can be, for example, a voice message with instructional content directed to an operator. For example, the instructional content of the audible message can direct an operator to shake the container vigorously for an appropriate prescribed period to ensure proper mixing or dispersion of the container contents, such as a developer composition comprising a toner and carrier particles. For a typical developer, shaking or equivalent agitation can be for from about 10 seconds to about 10 minutes, and can depend upon such factors as the intensity of the shaking, the composition of the contents, and the extent of their predispersion. The instructional content in embodiments can, for example, direct an operator to shake the container with a specified intensity. The instructional content in embodiments can, for example, direct an operator to cease shaking the container after a sufficient or appropriate period of time. The instructional content in embodiments can, for example, direct an operator to first, start shaking the container and then to second, after a period of time, stop shaking the container, for example, with the instructions or commands "Please start shaking the cartridge now . . . Please stop shaking the cartridge now." The resulting shaken contents of the container are preferably properly dispersed and suitable for subsequent use in a printing machine. In embodiments the audible signal can be, for example, music, or combinations of music and voice. The audible message can, alternatively or additionally, have for example, promotional content, for example, the words "For superior copy quality use only Xerox brand toners," or "for best digital printing results select only Xerox brand supplies." In another example, the promotional content can be a reorder or restock message, for example, the words "When ordering toner supplies for this printer please specify Xerox Model Number XXXX", "When ordering replenisher supplies for this printer please specify Xerox Part Number YYYY", or "Please call toll-free 1-800-822-2200", or "Logon to the world wide web at <www.xerox.com > to reorder your Xerox quality printing supplies." In embodiments, the promotional content can be, for example, a voice logo message, for example, the words "The Document Company—Xerox".

The contents of the cartridge can be, for example, a dry toner, a dry developer, a liquid developer, or a liquid ink formulation, and other consumable materials, such as fuser oils, and the like materials.

The closure, particularly an undisturbed or uninfringed closure, can indicate, for example, either by visual inspection, or preferably by a preprogrammed and stored test message, that the container is filled with particular or identifiable contents, for example, a toner or developer suitable for use in XYZ model printers. Such audible messages which identify specific consumable materials or specific compatible printing machine model number(s) for which the consumable materials are suitable can be especially useful to visually impaired or illiterate individuals.

In embodiments the signal module can for example, further include a motion sensor, such as an accelerometer. The motion sensor can be activated, for example, by a user-operator such by infringing the closure which activates the signal module and the signal module can in turn activate the motion sensor. Once activated, the motion sensor can, for example, beneficially sense, measure, and remember or record the sum total motion applied to the container and can issue one or more audible signals or messages to a user, such as, to indicate that a sufficient level of motion in the form of shaking or agitation has been applied to the cartridge container. In embodiment the smart cartridge articles of the present invention can further include a vibrator, for example, in electrical communication with the signal module and wherein, for example, the resulting activated signal module can activate the vibrator and wherein the vibrator vibrates the container and the container contents. The vibrator can preferably vibrate the cartridge for a predetermined period of time, for example, for about 10 seconds to about 10 minutes.

In an exemplary embodiment of the present invention there is provided a cartridge comprising:

a container with an opening which container is adapted to accommodate and dispense particulate material;

a removable first seal adapted to prevent escape of particulate material from the opening of the container;

a signal module in contact with the removable first seal and in at least physical communication with the container; and a breakable second seal adapted to provide a quality seal over the signal module and the removable first seal, the second seal being further adapted to activate the signal module when the second seal is infringed by a user, such as broken or disturbed.

The removable first seal and removable second seal can be comprised, for example, of a flexible sheet with an adhesive on the container facing side wherein the adhesive temporarily fixes, for example, the flexible sheet or sheets either to the container or to each other. The second seal in embodiments can be, for example, infringed or broken by scratching off at least a portion of the second seal. Scratching off a portion of the seal, for example, a scratchable coating material as commonly found in "scratch-off" card games, such as instant lottery tickets, can be used to activate the signal module. Alternatively or additionally, the signal module can provide a mixed or compound message or messages that can include, for example, motivational content messages, such as "shaking this container for 15 seconds will provide superior print quality and reduce total cost per printed page", remunerative content messages, such as "Get fast cash back by recycling this cartridge! Please send to . . . (address or regional contact number)", and premium offer messages, including games-of-chance, sweeps-stakes, or instant-winner merchandising such as "Now shake for 15 seconds to see if you won". The audible signal can include, for example, from 1 to about 1,000 messages, or more, and is limited by the length of individual messages and the electronic, such as energy supply, and memory capabilities of the signal module. The audible signal can include, for example, a first "start" state message. A user can thereupon respond to the first "start" state message by shaking the container to agitate the container's particulate contents. The audible signal can include, for example, a second "continue" state message. A user can thereupon respond to the second "continue" state message by continuing to shake the container to further agitate the container's particulate contents. The audible signal can include, for example, a third "ready" state message. The user-operator can respond to the third "ready" state message by, for example, ceasing to shake the container's particulate contents. Thereafter, for example, if the instructions have been faithfully or substantially followed the particulate material within the container is substantially free of blocking or caking, or free of inhomogeneous particulate components when the "ready" signal is issued by the cartridge article to the user-operator. The signal module can include an activation switch in communication with the removable second seal and which activation switch can activate the signal module when the second seal is removed from the switch. The signal module can, in embodiments, include a sound generator adapted to generate one or more humanly audible messages when the signal module has achieved, for example, a predetermined motion quantity or quality value and which value corresponds to a minimum motion level sufficient to provide substantially satisfactory premix or dispersion properties to the particulate contents of the container. A sound generator can be, for example, known audio producing microchips, and can include for example, an audio speaker or equivalent structures, and the like audio generating devices and combinations thereof. An audible signal can be any word or combination of words, for example, a "start" signal; a "continue" signal; and a "ready" signal, which communicate or direct, or instruct a human user or operator to execute one or more useful operations. Alternatively or additionally an audible signal can be any sound which can symbolically inform a conditioned user-operator, such as a bell-tone sound to start, a gentle beep-tone to continue, and a buzzer-toner sound to stop.

The signal module can, in embodiments, include a motion sensor adapted to detect motion applied to the container and which motion exceeds a particular force level or range. The signal module can be further adapted to monitor movement of the particulate material within the container and to otherwise sense the movement of the particulate material in the container, and if desired, independent of the motion of the container; or to monitor the condition of the particulate material in the container. The signal module can include a central processor including a counter and memory, and can be further adapted to record and sum the forces applied to the cartridge or container, and can thereby be adapted to issue electrical signals to the sound generator in a predetermined sequence to produce an audible messages.

In an exemplary embodiment, a sound generator and its corresponding electric circuit design suitable for use in the present invention can be readily fashioned from known and commercially available components. A talking toner or replenisher cartridge of the present invention can include an activation device such as a pressure-sensitive switch or a motion sensor which, when activated, for example, by removing the protective first quality seal from the container or by shaking the cartridge, electrically energizes an audio system housed within the signal module to playback a pre-recorded audio message and which message can augment or substitute for visual information presented by, for example, printed label, printed packaging, or collateral documentation information accompanying the cartridge. The switch can be, for example, a leaf spring switch actuator which is temporarily, that is, during the time between packaging to the time a customer or user removes the quality seal, affixed to the signal module by the quality seal in an "open" switch position which renders the signal module de-energized and idle. When the quality seal is removed by a customer the switch flexes outwardly to produce an "closed" switch position thereby energizing and activating the signal module by producing a control signal which initiates an event sequence, for example, playback of a recorded message, reference for example, the aforementioned U.S. Pat. No. 5,499,465. Alternatively, the removal of an opaque strip can energize a photovoltaic device which powers the audible playback of the prerecorded message. The pre-recorded message can also include embedded ultrasonic signals for transmission to the host receiver as described below. A timing circuit can be included so that shaking for the length of time directed by the audible instructions must be completed before an embedded signal, such as radio or ultrasonic, is transmitted to the host receiver.

In other embodiments the signal module can be an "acoustic label" comprising a circuit board substrate, preferably flexible, with a sound-generating microchip and a integral connected portable power source, such as a battery or a photovoltaic cell, to provide power to the sound-generating microchip. A sound reproduction unit or speaker can also attached to the substrate and can be connected to the sound-generating microchip which communicates signals to the sound reproduction unit which are then converted by the sound reproduction unit to audible sounds. In embodiment the acoustic label can further include a transmitter module which transmits electromagnetic waves, such as light, infrared, microwaves, radio waves, and the like waves, from the signal module to an electromagnetic wave receiver circuit situated in, or on, a printer or copying machine which machine is in close proximity to the signal module and container, and the receiver is preferably situated in close proximity to the electronic controls associated with either the development system or diagnostic system of the printer or copying machine. Alternatively and preferably, this aforementioned communication to the host machine can be carried out solely by acoustic means. The transmitter module sends specific sound wave signals from the signal module to receiver module, such as a microphone, where the receiver module converts selected or filtered sound wave signals to electric signals. The electrical signals generated in the receiver can be used to actuate, for example, lock-and-key assembly which permits a properly authenticated cartridge to be installed into the printer or copying machine. A properly authenticated cartridge means, for example, a cartridge which has proper characteristics, such as, container size dimensions; containing the proper imaging material which are compatible with the host machine; and imaging material(s) in the cartridge that are in a proper state of mixing, for example, as determined by the receipt of the radio or ultrasonic transmission signaling the proper completion of the mixing period. Acoustic labels are known, reference for example, the aforementioned U.S. Pat. No. 5,905,429. Alternatively or additionally, a suitable transmitter module can be fashioned from other known and commercially available wireless transmitting chip technologies and protocols, for example, Bluetooth, WLAN, TDMA, GSM, CDMA, PCS, and the like methologies. In a specific example, and in its simplest form, Bluetooth is a integrated circuit chip with radio technology built into it. The Y2K price of a Bluetooth chip is from about $10 to $20 US in quantity and a price of about $5 is expected in about two to four years. Bluetooth type chip technology can enable, for example, notebook and desktop personal computers (PCs), personal digital assistants, such as Palm Pilots, printers, faxes, cell phones, and the like devices to communicate with each other within short range distances.

In embodiments the present invention provides an article comprising:

a container with an opening which container is adapted to accommodate and dispense the contents therefrom;

a closure in contact with the container;

a signal module in communication with the closure; and a transmitter module adapted to send a signal or signals from the signal module to a receiver module resident in a target printing machine.

The article provides a cartridge-machine interconnection, that is, the cartridge or other consumable material or component can communicate with a printing machine to effectively assure that the proper cartridge or other consumable material or component is installed and used in the machine. The article of the present invention can be, for example, a toner-developer replenisher bottle and the particulate material can be developer particles comprised of toner particles and carrier particles.

The target printing machine can be, for example, adapted with a receiver module to receive transmitted signals from a transmitting article, such as, a toner or developer cartridge. A target, nearby, or adjacent printing machine is one which is suitably equipped and configured to receive the transmitted signals and is situated within suitable proximity of the transmitting article, for example, from about 1 to about 25 feet, to permit the signal to be received free of, for example, interruption, distortion, deletion, and the like signal interference or signal defects. The signals can be, for example, those signals known in the electromagnetic spectrum, and preferably are, for example, infrared waves, radio waves, or ultrasonic waves. The receiver module can be, for example, adapted to receive, process, or act upon the signals received from the transmitter module. The receiver module in embodiments, can be configured to decide or determine the "fit" of the article within the printing machine. The term "fit" refers to, for example, the physical fit or the physical dimensions of the article, such as a cartridge, within the printing machine. Alternatively, fit can refer to the compatibility of the contents of the article to suitably function within the printing machine, for example, a developer composition contained in a developer or replenisher cartridge article of the present invention. The "fit" can be predetermined or preset, and can be, for example, "absolute" wherein only a specific formulation or material content in the container will be accepted for use or as usable by the printing machine. Alternatively, the fit can be "relaxed" or tolerant, wherein for example, a range of similar or related formulated compositions, or for example similar or related brands, can be deemed to be acceptable for proper machine function and operation. The installation status of the article in the printing machine can include, for example, whether the contents of the article, such as, a toner or developer cartridge is suitable for use in the targeted printing machine. That is, the suitability or compatibility of a signaling cartridge article as a guest to properly fit and properly function, that is dimensionally, compositionally, or both, within a receiving or host printing machine.

In an embodiment, the receiver module can receive one or more messages from the transmitter module, and thereafter processes, for example digitally, the information contained in the signal and thereafter acts upon or decides, for example, whether to admit or deny installation of the aforementioned cartridge into the host printing machine depending, for example, upon either direct or indirect measures of the agitation or motion quantity, or quality, state of the cartridge and its contents. In another embodiment, the receiver module can be further adapted to notify a machine user with an appropriate message, such as with a receiver module generated audio signal or a user interface display instruction, that reflects the receiver module's decisional result, for example, to admit or deny installation of the cartridge and optionally an accompanying message that includes, for example, a reason, basis or rationale for the module's decisional result, such as a reason for denying access or proper "fit". Other receiver module generated audio signals or messages can include, for example, step-by-step audio instructions to a user on the step or steps required for proper cartridge installation; trouble shooting tips; an acknowledgement of proper or successful completion of a cartridge installation operation, and combinations, variations, modifications, and extensions of the aforementioned instructions or messages. The receiver module can also be configured to act to inform a user-operator on matters relating to the installation status of the article in the printing machine. The receiver module can, for example, further comprise a second signal module adapted to produce an audible signal or signals in response to a signal for the first signal module. The second signal module can, for example, produce at least one signal which informs a user-operator whether the signaling article, such as a toner cartridge, is or unsuitable for use in the target printing machine. The transmitter module can be adapted to send and the a receiver module can be adapted to receive, for example, ultrasound wavelength signals, infrared wavelength signals, radio wavelength signals, or combinations thereof, for example, the near infrared, far infrared, intermediate infrared, and combinations thereof. The ultrasound signals can provide a convenient and economic method of communicating between, for example, a smart developer cartridge and a host or target printing machine. Similarly, infrared and radio wavelength signals can be selected as the correspondence medium. The correspondence or content of the message can indicate, for example, whether the signaling article is unsuitable or suitable for use in the target printing machine, and preferably the second signal module can produce its informational signal to the user-operator prior to the installation or attempted installation of the article in the target printing machine.

A proper acoustic signature, that is an audible constant message, for example, "This cartridge is recommended for use in XYZ Model(s)" or "This cartridge is for use only in XYZ Model(s)" will help prevent operator induced equipment failure or impaired performance, such as the installation of an incorrect or mismatched developer materials package cartridge in a particular machine or class of machines, for example a mismatch of a Xerox Model 5800 developer cartridge in a Xerox Model 5090 copying machine.

In embodiments the present invention can further comprise a receiver adapted to receive signals from without, that is, outside or external to the article, such as a smart cartridge. An external signal can be, for example, environmental information, user-operator supplied information, machine model numbers, and the like information. The present invention can further comprise an article wherein the aforementioned transmitted signal from the signal module can be readily reprogrammed. The signal can be, for example, reprogrammed manually, or alternatively automatically, reference for example, the aforementioned U.S. Pat. No. 5,577,918, the disclosure of which is incorporated herein by reference in its entirety. Automatic reprogramming can be potentiated by for example, upon the occurrence of some predetermined event, such as, the intentional or inadvertent act of a user-operator. As an example, the signal in the form of an audible message can be changed or altered by a user-operator, for example, by following or executing a proper sequence of steps or actions, such as by shaking a cartridge for a proper threshold period of time or by shaking the cartridge with the proper threshold intensity. Similarly, the signal in the form of a message can be changed or altered after a user accomplishes a particular task or sequence of tasks.

In embodiments the audible message delivered by the smart cartridge or CRU to the user-operator can be automatically reprogrammed, reassigned, or redirected, that is the original audible message can be changed, modified, or substituted to a new message, for example, upon the happening of a subsequent event or change in condition, such as, when the cartridge or CRU attains a "low" or "empty" status, which condition could produce a low or "out-of-toner" signal, or the cartridge or CRU is removed from its place of repose in the printing machine. Thus when the cartridge or CRU is, for example, emptied or removed from the host printing machine, a new or different message can be played or broadcast in place of the original message. Examples of original or reprogrammed messages include conveying information about cartridge or CRU concerning: installation and use, preparatory steps, safety and handling, reuse, return, or proper disposal options. Audible messages can advantageously replace or supplement conventional printed instructions and label information, such as cartridge return instruction sheets, to simplify operator use and CRU deployment and reduce collateral costs. Reprogramming the audible message could include, for example, destroying or erasing a part or the entire acoustic signature, so that the cartridge cannot be reused, by anyone, for example, after the cartridge is removed from the machine, opened, or refilled. Alternatively or additionally, the cartridge could be manually reprogrammed by an authorized local user or technical representative in appropriate circumstances, for example, where service requires removal of the cartridge or CRU during its normal service life, such as for inspection or access, and thereafter returned to the machine for continued use.

In embodiments the present invention provides a method of operating a printing apparatus, for example a light lens, digital, offset, and the like type printing apparatuses, comprising:

providing a subsystem in the apparatus, the subsystem being disposed in a module which is separable from the apparatus, the module having permanently associated therewith an electronically-readable memory;

polling the electronically-readable memory of the module for compatibility information prior to the installation and use of the module in the apparatus; and comparing the compatibility information of the module with compatibility information resident in an electronically-readable memory in the printing apparatus.

Thus if the comparison of the compatibility information provides a compatible match between the module and the printing apparatus then a match signal is generated and thereafter a match audible message is transmitted. However, if the comparison of the compatibility information provides an incompatible match between the module and the printing apparatus then a mis-match signal is generated and a mismatch audible message is transmitted. In embodiments the module can be a customer governed unit. A customer governed unit is for example, a module or modular component of the printing apparatus wherein the customer or user-operator can, for example, either or both, install or replace the unit at the customer's own discretion or by, for example, at the direction or prompting of an audible message produced from either or both the printing apparatus or the customer governed unit. The customer governed unit can be, for example, a toner cartridge, a developer-replenisher cartridge; a fuser roll, a photoreceptor, and the like consumable products.

Referring to the Figures, FIG. 1 illustrates, for example, a cross-section view of a signaling container article 10 in embodiments of the present invention. Thus for example, a bottle or container 20 filled with a toner or developer or other similar particulate formulations 30 or liquid formulations, and the like material formulations, with a fill and dispense opening 40, can be fitted with a first seal 50, which first seal can be surmounted by module 60. Module 60 can be adapted in a number of different ways to fulfill various embodiments of the present invention and can include for example, a motion sensor, an audio signal generator, an electromagnetic wave or signal generator, such as a radio or microwave transmitter, a central processing or control unit, and combinations thereof. Module 60 can be surmounted by a second seal 70. In embodiments first seal 50 and module 60 can be integrated into the same layer or same closure element. Alternatively, in embodiments second seal 70 and module 60 can be integrated into the same layer or closure element. Still in other embodiments, seal 50, module 60, and seal 70 can be integrated into the same layer or closure element. In yet another embodiment, seal 50 and seal 70 can be integrated into the same layer or closure element while module 60 can be displaced from a sandwiched relationship(as shown in FIG. 1) and adapted to be at least in physical attachment or electrical contact with either or both seal 50 and seal 70, for example as a post manufacture premium add-on, for example, as a "working" label.

Figure 2:
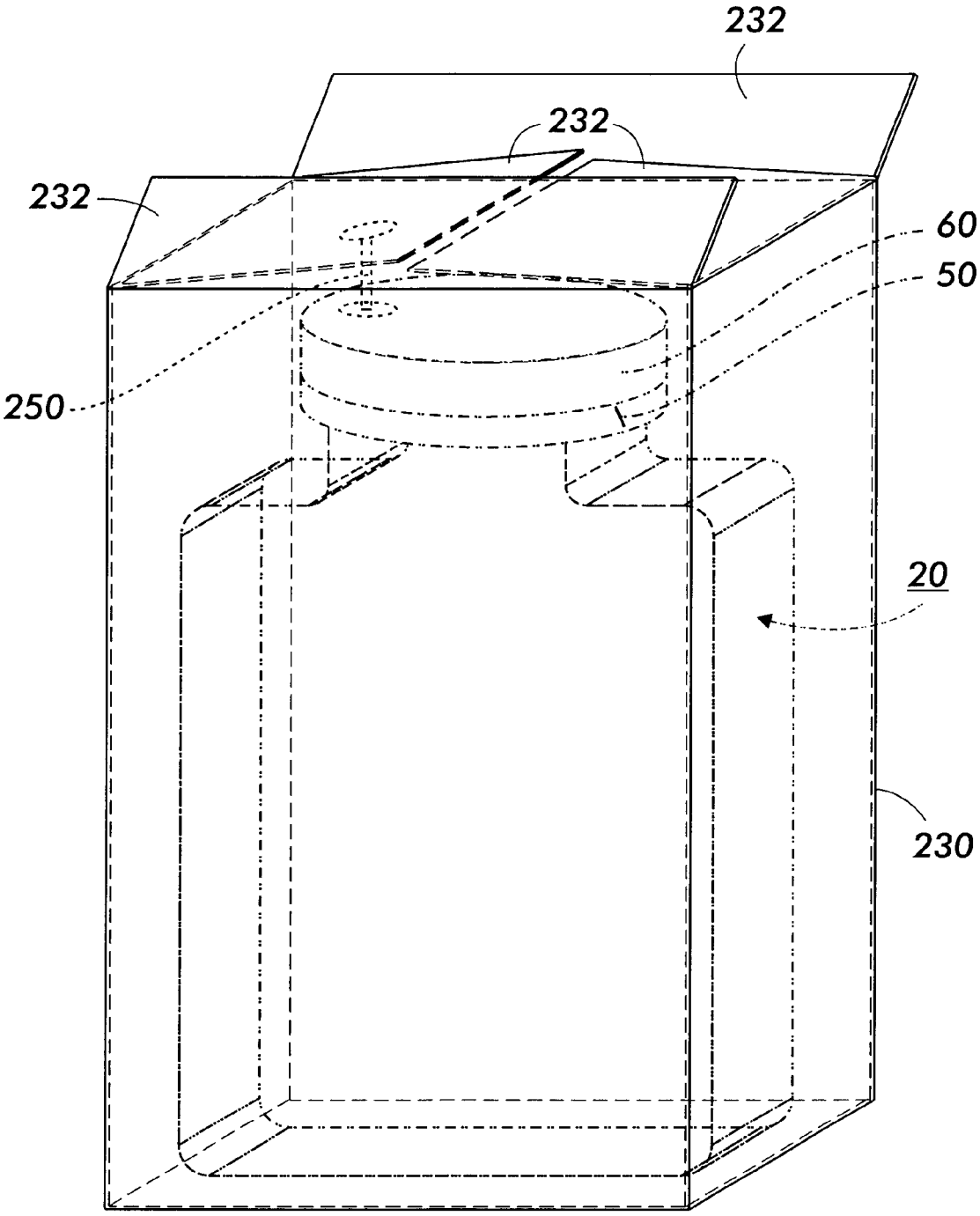
FIG. 2 illustrates a perspective view of an exemplary packaged container article and associated closure which provides, upon activation, a signal to user-operator or a target printing machine, in embodiments of the present invention.

FIG. 2 illustrates a perspective view of an exemplary packaged container article and associated closure which can provide, upon activation, a signal to a user operator. Thus a packaged container article or bottle 20 can have a first seal 50, a signal or motion module 60 can in embodiments be packaged in a suitable closure 230, such as a corrugated cardboard box, plastic container or bag, or the like closures, and which closure can include, for example, one or more flaps 232, and which flaps can have at least one flap connected to the container or cartridge article 20 by a second breakable seal 250 which can act as a seal-switch that once broken can activate the signal or motion module 60. Seal 250 can be constructed by known manufacturing methods and made of, for example, a rigid material or preferably a slightly elastic material which elastic material resists or does not break under typical forces encountered in, for example, rigorous shipping and handling operations, but will break when intentional and deliberate force is applied to opening closure 230 or removing flap 232. Thus seal 250 in effect can act as a "rip cord" that when pulled with sufficient force breaks or alternatively activates the signal-sensor module 60.

Figure 3:
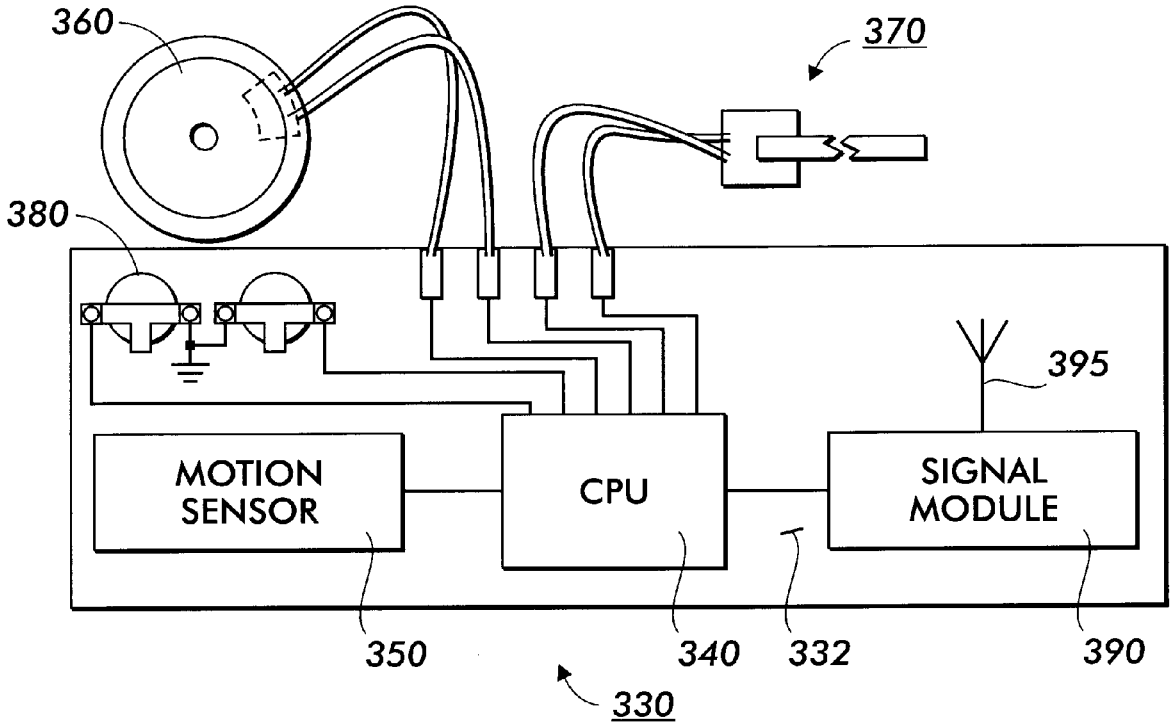
FIG. 3 illustrates an exemplary circuit and associated componentry of a communications or signal module of a container article in embodiments of the present invention.

FIG. 3 illustrates an exemplary circuit and associated componentry of a sensor-communications signal module 330 of a container article in embodiments of the present invention. Module 330 can include for example, an optional rigid or flexible mounting board 332 and a central processing or control unit 340 which control unit can be connected to, for example, a known motion sensor 350, an audio speaker 360 or sound generator adapted to produce a user-operator audible signal, a switch member 370 such as a pressure sensitive or motion sensitive switch which can be activated, that is opened or closed appropriately to complete or break an electrical circuit and thereby enable other componentry in the circuit to be appropriately activated, a battery or power source 380 adapted to energize or power the activated module components, and a signal or transmitter module 390 adapted to transmit signals to an appropriately adapted receiver member and which transmitter module can include an antenna 395 or equivalent means.

Figure 4:
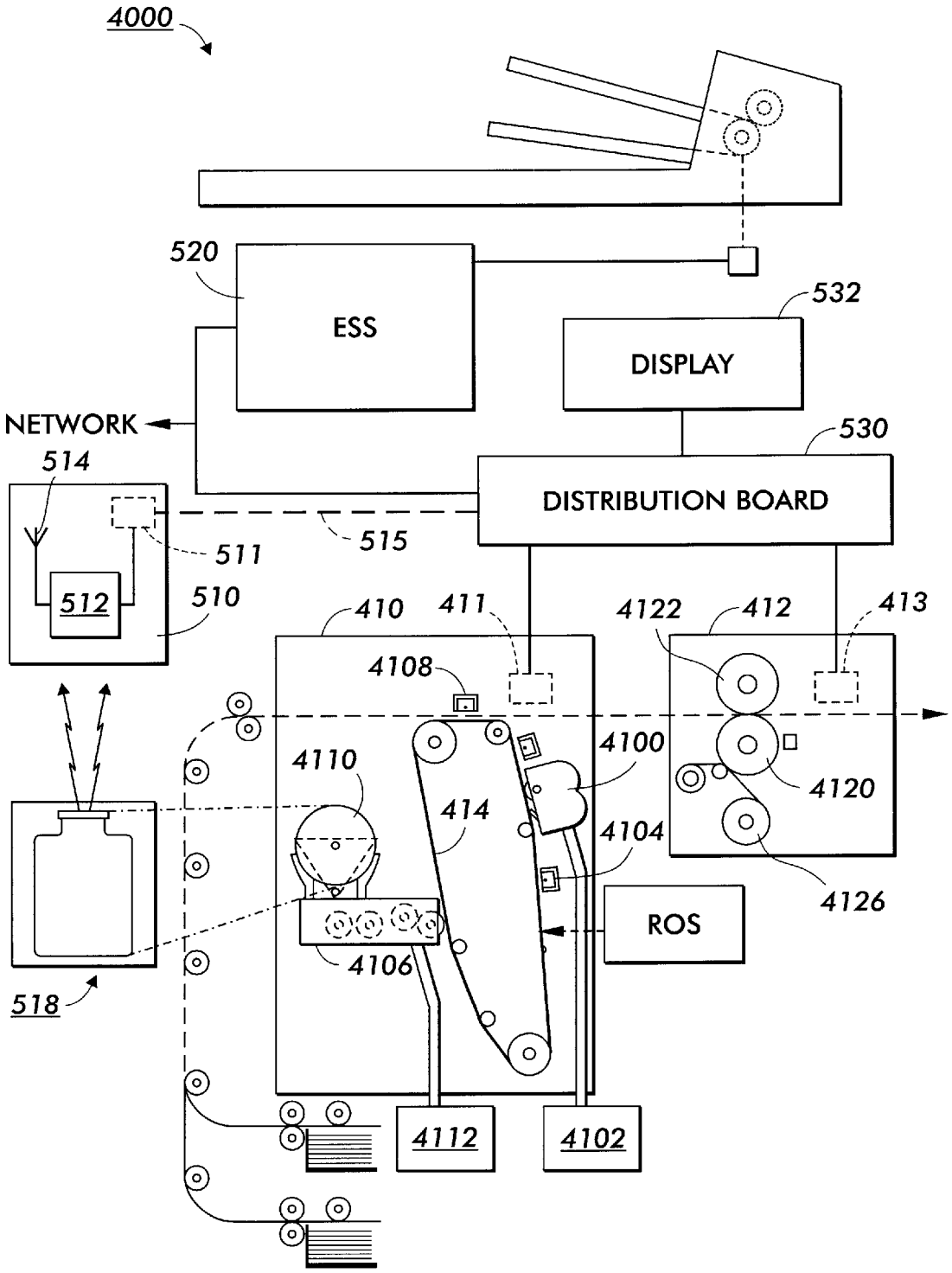
FIG. 4 is a simplified, partially-elevational, partially-schematic view of an electrophotographic printing apparatus adapted to communicate with a container article in which many of the aspects of the present invention can be embodied.

FIG. 4 is a simplified, partially-elevational, partially-schematic view of an electrophotographic printing apparatus 4000 adapted to communicate with a container article 518 (shown in a transmitting mode), such as the aforementioned container articles discussed in FIGS. 1 and 2, by way of machine resident or retrofitted communications module 510 equipped with a communications chip 512, such as the aforementioned Bluetooth or equivalent communications chip and an receiver-transmitter antenna 514.

The two main portions of hardware in the machine include a "xerographic module" indicated as 410, and a "fuser module" indicated as 412. As is familiar in the art of electrostatographic printing, there is contained within xerographic module 410 many of the essential hardware elements required to create desired images electrophotographically. The images are created on the surface of a rotating photoreceptor 414 which is mounted on a set of rollers, as shown. Disposed at various points around the circumference of photoreceptor 414 is a cleaning device generally indicated as 4100, which empties into a "toner reclaim bottle" 4102, a charging corotron 4104 or equivalent device, a developer unit 4106, and a transfer corotron 4108. Of course, in any particular embodiment of an electrophotographic printer, there may be variations on this general outline, such as additional corotrons, or cleaning devices, or, in the case of a color printer, multiple developer units.

With particular reference to developer unit 4106, as is familiar in the art, the unit 4106 generally comprises a housing in which a supply of developer, which developer typically contain toner particles plus carrier particles, and which developer can be supplied to an electrostatic latent image created on the surface of photoreceptor 414 or other charge receptor. Developer unit 4106 may be made integral with or separable from xerographic module 410; and in a color-capable embodiment of the invention, there would be provided multiple developer units 4106, each unit developing the photoreceptor 414 with a different primary-color or custom-color toner. A toner bottle 4110, which could contain either pure toner or an admixture of carrier particles, continuously or selectably adds toner or developer into the main body of developer unit 4106, and which toner bottle can communicate with the aforementioned communications module either externally, that is before installation, or after installation into the machine 4000, and as suggested by the exploded assembly dot-dash lines in the figure. In one particular embodiment of an electrophotographic printer, there is further supplied a developer receptacle here indicated as 4112, which accepts excess developer directly from the housing of development unit 4106. In this particular embodiment, the developer receptacle 4112 should be distinguished from the toner reclaim bottle 4102, which reclaims untransferred toner from cleaning device 4100. Thus, in the illustrated embodiment, there are two separate receptacles for used or excess developer and toner.

Turning to fuser module 412, there is included in the present embodiment all of the essential elements of a subsystem for fusing a toner image which has been electrostatically transferred to a sheet by the xerographic module 410. As such, the fuser module 412 includes a pressure roll 4120, a heat roll 4122 including, at the core thereof, a heat lamp (not shown), and a web supply 4126, which in effect provides a release agent to the outer surface of heat roll 4122 so that paper passing between heat roll 4122 and pressure roll 4120 does not stick to the heat roll 4122.

Paper or other medium on which images are desired to be printed are retained on one or more paper stacks. Paper is drawn from the stacks, typically one sheet at a time, by feed rolls. When it is desired to print an image on a sheet, a motor (not shown) activates one of the feed rolls, depending on what type of sheet is desired, and the drawn sheet is taken from the stack and moved through a paper path, shown by the dot-dash line in the Figure, where it eventually comes into contact with the photoreceptor 414 within xerographic module 410. At the transfer corotron 4108, the sheet receives an unfused image, as is known in the art. The sheet then passes further along the paper path through a nip formed between pressure roll 4120 and heat roll 4122. The fuser subsystem thus causes the toner image to be permanently fixed to the sheet, as is known in the art.

In a digital printing apparatus, whether in the form of a digital printer or in a digital copier, images are created by selectably discharging pixel-sized areas on the surface of photoreceptor 414, immediately after the surface is generally charged such as by corotron 4104. Typically, this selective discharging is performed by a raster output scanner (ROS) which, as is known, includes a modulating laser which reflects a beam off a rotating reflective polygon. Other apparatus for imagewise discharging of the photoreceptor 414, such as an LED bar or ionographic head, are also known. The image data operative of the ROS or other apparatus typically generated by what is here called an "electronic subsystem" or ESS, here indicated as 520.

The ESS 520 can receive original image data either from a personal computer, or one of several personal computers or other apparatus on a network, or, in the case where the apparatus is being used as a digital copier, via a photosensor bar. Briefly, the photosensor bar typically includes a linear array of pixel-sized photosensors, on which a sequence of small areas on an original hard-copy image are focused. The photosensors in the array convert the dark and light reflected areas of the original image into electrical signals, which can be compiled and retained by ESS 520, ultimately for reproduction through ROS.

If the apparatus is being used in digital copier mode, it is typically desired to supply an original document handler to present either or both sides of a sequence of hard-copy original pages to the photosensor bar. As is familiarly known, a document handler may include any number of rollers, nudgers, etc.

According to one aspect of the present invention, there is further provided within an electrophotographic printing/copying apparatus, what is here called a "distribution board" 530. The distribution board 530 can send or receive messages, as will be described below, through the same network channels as ESS 520, or alternatively through a telephone or facsimile line (not shown); alternatively, the distribution board 530 can cause messages to be displayed through a display 532, typically in the form of a touch screen disposed on the exterior of the apparatus.

Distribution board 530 interacts with specially-adapted memory devices, here called "customer-replaceable unit monitors," or CRUMs, which are associated with one or more customer-replaceable modules within the apparatus. In embodiments, xerographic module 410 and fuser module 412 are each designed to be customer-replaceable; that is, for servicing purposes, the entire module 410 or 412 is simply removed in its entirety from the apparatus, and can then be immediately replaced by another module of the same type. As is familiar in the copier or printer industry, consumers can buy or lease individual modules as needed, and typically replace the modules without any special training. As illustrated, the xerographic module 410 has associated therewith a CRUM 411, while the fuser module 412 has associated therewith a CRUM 413. In a particular embodiment, the xerographic module 410 may further have associated therewith the toner reclaim bottle 4102 and the developer receptacle 4112, both of which are separable units.

The overall purpose of each CRUM 411 and 413 is to retain information for the particular module about how that module is being used within a machine. Each CRUM 411 or 413 can be considered a small "notepad" on which certain key data is entered and retained, and also periodically updated. Thus, if a particular module 410 or 412 is removed from an apparatus, the information will stay with the module. By reading the data that is retained within a CRUM at a particular time, certain use characteristics of the CRUM can be discovered.

According to an embodiment of the present invention, the CRUM 411 or 413 is basically in the form of a 2K bit serial EEPROM (electrically erasable programmable read only memory). Each CRUM 411, 413 is connected to distribution board 530 using a hardwire (as shown) connection or alternatively a wireless architecture as is evident from the aforementioned disclosure. The non-volatile memory within the CRUM is designed for special applications requiring data storage, for example, in a ROM, PROM, or EEPROM mode. There is also preferably included in the device a special protection circuit which can be activated only one time. If this protection circuit is used, the memory content cannot be accessed regardless of the power supply or bus conditions. Each CRUM such as 411 or 413 can serve as both a transmitter and receiver in the synchronous transfer of data with distribution board 530 in accordance with a bus protocol.

The bus connecting distribution board 530 with one of the CRUMS 411 or 413 comprises two bidirectional lines, one for data signals and the other for clock signals. In an embodiment of the present invention, each data transfer, either data being sent to the CRUM or recordation therein, or being sent out of the CRUM for reading thereof, is initiated with a special "start data transfer" condition, which for example could be defined as a change in the state of the data line from high to low, while the clock is high. Each data transfer, in either direction, is terminated with a stop condition, one example of which can be a change in the state of the data line from low to high while the clock is high. The serial data passing between the distribution board 530 and a CRUM thus exists between the start condition and the stop condition; in an embodiment, the number of data bytes between the two conditions is limited to 8 bytes when updating data within the CRUM, and is not limited when reading data out of the CRUM. Typically, each byte of 8 bits is followed by one acknowledge bit. This acknowledge bit is a low level put on the bus by the CRUM, whereas the distribution board receiving the data will generate an extra acknowledge-related clock pulse.

With respect to the different types of data which can be stored in a CRUM such as 411 or 413 to be read or updated by distribution board 530, the following detailed descriptions of each type of data can be applied to either CRUM 411 or CRUM 413, although of course certain types of data will be particularly unique to one type of module, either the xerographic module 410 or the fuser module 412.

From a complete comprehension of the foregoing, it is readily appreciated by one of ordinary skill in the art that communications module 510 can be similarly configured via hardwire connection 515 or by wireless connection to link up with distribution board 530 to enable a CRUM 511 to function in an analogous fashion as CRUM 411 or CRUM 413 and to further enable the CRUM 511 to record and communicate status information about an incumbent or prospective developer formulation contained, for example, in external bottle 518, and further communicate the status information to a remote network if desired. It is readily appreciated that communications module 510 can be physically or communicatively accommodated within and cooperate with the aforementioned functioning of xerographic module 410.

Other modifications of the present invention may occur to one of ordinary skill in the art based upon a review of the present application and these modifications, including equivalents thereof, are intended to be included within the scope of the present invention.

What is claimed is:

1. An article comprising:

a container with an opening which container is adapted to accommodate and dispense the contents therefrom;

a closure in contact with the container;

a signal module in communication with the closure and wherein if the closure is infringed by an operator then the signal module is activated, a vibrator in electrical communication with the signal module wherein the resulting activated signal module activates the vibrator which vibrates the container and the container contents and wherein the vibrator vibrates for a set period of time.

2. The article in accordance with claim 1, wherein the closure must be infringed by an operator before the contents of the container can be dispensed.

3. The article in accordance with claim 1, wherein the resulting activated signal module generates an audible signal.

4. The article in accordance with claim 3, wherein the audible signal is a voice message with instructional content directed to an operator.

5. The article in accordance with claim 4, wherein the instructional content directs an operator to shake the container.

6. The article in accordance with claim 4, wherein the instructional content directs an operator to shake the container for a specified time period.

7. The article in accordance with claim 4, wherein the instructional content directs an operator to shake the container with a specified intensity.

8. The article in accordance with claim 4, wherein the instructional content directs an operator to cease shaking the container.

9. The article in accordance with claim 4, wherein the instructional content directs an operator to first start shaking the container and to second, after a period of time, stop shaking the container.

10. The article in accordance with claim 9, wherein the resulting shaken contents of the container are properly dispersed and suitable for subsequent use in a printing machine.

11. The article in accordance with claim 3, wherein the audible signal is music.

12. The article in accordance with claim 3, wherein the audible signal is music and voice.

13. The article in accordance with claim 3, wherein the audible message has promotional content.

14. The article in accordance with claim 3, wherein the promotional content is a reorder message.

15. The article in accordance with claim 3, wherein the promotional content is a voice logo message.

16. The article in accordance with claim 1, wherein the contents is a dry toner, a dry developer, a liquid developer, or a liquid ink formulation.

17. The article in accordance with claim 1, wherein the closure indicates the container is filled with contents.

18. The article in accordance with claim 1, wherein the signal module includes a motion sensor.

19. A cartridge comprising:

a container with an opening which container is adapted to accommodate and dispense particulate material;

a removable first seal adapted to prevent escape of particulate material from the opening of the container;

a signal module in contact with the removable first seal and in at least physical communication with the container; and a breakable second seal adapted to provide a quality seal over the signal module and the removable first seal, the second seal being further adapted to activate the signal module when the second seal is broken by a user.

20. The cartridge in accordance with claim 19, wherein the second seal is broken by scratching off at least a portion of the second seal.

* * * * *